US008646594B2

(12) United States Patent
Paterlini

(10) Patent No.: US 8,646,594 B2
(45) Date of Patent: Feb. 11, 2014

(54) APPARATUS FOR AUTOMATIC TRANSFER OF TEXTILE ARTICLES FROM A LINKING MACHINE TO A BOARDING MACHINE

(75) Inventor: Stefano Paterlini, Rezzato (IT)

(73) Assignee: Santoni S.p.A., Brescia (IT)

( * ) Notice: Subject to any disclaimer, the term of this patent is extended or adjusted under 35 U.S.C. 154(b) by 38 days.

(21) Appl. No.: 13/027,853

(22) Filed: Feb. 15, 2011

(65) Prior Publication Data

US 2011/0158785 A1 Jun. 30, 2011

Related U.S. Application Data

(62) Division of application No. 11/997,683, filed as application No. PCT/IT2005/000476 on Aug. 4, 2005, now Pat. No. 7,913,834.

(51) Int. Cl.
*B65G 47/00* (2006.01)

(52) U.S. Cl.
USPC ..... 198/617; 198/470.1; 198/377.03; 198/612; 223/40; 223/42; 223/75

(58) Field of Classification Search
USPC ..... 198/377.03, 470.1, 612, 617; 223/39, 223/40, 41, 42, 75; 112/470.15, 475.12
See application file for complete search history.

(56) References Cited

U.S. PATENT DOCUMENTS

| | | | | |
|---|---|---|---|---|
| 2,191,577 | A | | 2/1940 | Mills |
| 2,842,298 | A | | 7/1958 | Hill |
| 3,054,542 | A | | 9/1962 | Glaze, Jr. et al. |
| 3,319,849 | A | | 5/1967 | Horberg, Jr. |
| 3,331,506 | A | | 7/1967 | Smith et al. |
| 3,520,262 | A | | 7/1970 | Bolles et al. |
| 3,577,942 | A | * | 5/1971 | Hulin ..... 112/25 |
| 3,613,883 | A | | 10/1971 | Starbuck |
| 4,509,666 | A | | 4/1985 | Rosso |
| 4,515,299 | A | * | 5/1985 | Sewell et al. ..... 223/76 |
| 4,516,703 | A | | 5/1985 | Orosei |
| 4,564,133 | A | | 1/1986 | Gazzarrini |
| 4,598,817 | A | * | 7/1986 | Bell et al. ..... 198/468.2 |
| 4,602,710 | A | | 7/1986 | Bell, Jr. et al. |
| 4,627,557 | A | | 12/1986 | Canton |
| 4,658,995 | A | | 4/1987 | Teague |
| 5,040,475 | A | * | 8/1991 | Fournier et al. ..... 112/470.15 |
| 5,261,579 | A | | 11/1993 | Propach et al. |
| 5,373,977 | A | | 12/1994 | Migliorini |
| 5,497,235 | A | | 3/1996 | Bell |
| 5,505,350 | A | | 4/1996 | Migliorini |
| 5,564,609 | A | | 10/1996 | Tsuchiya et al. |
| 5,570,648 | A | * | 11/1996 | Burt et al. ..... 112/470.33 |
| 5,605,260 | A | | 2/1997 | Olivas Coll |

(Continued)

FOREIGN PATENT DOCUMENTS

| | | | |
|---|---|---|---|
| EP | 1178143 | A2 | 2/2002 |
| FR | 2839987 | A1 | 11/2003 |

*Primary Examiner* — Joseph Dillon, Jr.
(74) *Attorney, Agent, or Firm* — Pearne & Gordon LLP

(57) ABSTRACT

An apparatus (1) and a related method for automatic transfer of socks (4) from a linking machine (2) to a sock-modeling piece for boarding operation (36) according to a predetermined orientation, the apparatus comprising reversing means (20) comprising feeding means (21) for picking up the sock (4) from a sewing station (22) of the linking machine and loading means (31) for automatically loading the sock (4) onto the sock-modeling piece, the reversing means (20) comprising a supporting element (23) and at least one pair of lower rollers (24) disposed around said supporting element (23).

10 Claims, 6 Drawing Sheets

(56) References Cited

U.S. PATENT DOCUMENTS

| | | | | |
|---|---|---|---|---|
| 5,651,483 | A | 7/1997 | Bell et al. | |
| 5,941,431 | A | 8/1999 | Parker | |
| 6,132,166 | A | 10/2000 | Migliorini | |
| 6,192,655 | B1 * | 2/2001 | Todd et al. | 53/397 |
| 6,283,055 | B1 | 9/2001 | Salvetti | |
| 6,516,979 | B1 | 2/2003 | Migliorini | |
| 6,886,723 | B2 * | 5/2005 | Manini | 223/75 |
| 6,913,173 | B2 | 7/2005 | Manini | |
| 6,986,316 | B2 | 1/2006 | Lonati et al. | |
| 7,004,714 | B2 | 2/2006 | Bagni | |
| 7,025,011 | B2 * | 4/2006 | Jordan et al. | 112/470.08 |
| 7,044,071 | B2 | 5/2006 | Jordan et al. | |
| 7,076,897 | B2 * | 7/2006 | Bassi | 38/7 |
| 7,398,901 | B2 * | 7/2008 | Vouriot | 223/75 |
| 7,845,526 | B2 * | 12/2010 | Lonati | 223/111 |
| 2002/0124781 | A1 | 9/2002 | Migliorini | |
| 2003/0015398 | A1 | 1/2003 | Bagni | |
| 2004/0154510 | A1 | 8/2004 | Jordan | |
| 2004/0155074 | A1 | 8/2004 | Jordan et al. | |

* cited by examiner

APPARATUS FOR AUTOMATIC TRANSFER OF TEXTILE ARTICLES FROM A LINKING MACHINE TO A BOARDING MACHINE

The present invention relates to an apparatus for automatic transfer of textile articles from a linking machine to a boarding machine in which the textile articles are represented by knitted tubular textile artifacts such as socks for men, women or children. Therefore, these apparatus are set downstream of a linking machine for textile articles and upstream of a conventional boarding machine for textile articles.

It is known that in the manufacture of socks, a semifinished product is obtained by means of suitable circular knitting machines which consists of a tubular element that is open on the side both of the rubber band (from which knitting starts) and of the fingertip, said fingertip being closed by a suitable linking step. Subsequently some finishing steps are to be provided such as an automatic hot boarding.

Therefore, as well-known, the linking and boarding steps are separated from each other, and they are often carried out at completely different regions of the production plant.

In more detail, in a traditional process for sock production, said socks are for example contained in baskets and transferred from the knitting region to the linking region where the fingertips are sewn through use of handling means such as trucks or trolleys. A subsequent loading onto the linking machine can be carried out in two ways, i.e. automatically or manually. An automatic loading generally takes place through a pick-and-place station and a loader. In particular, in the pick-and-place station a sock is picked up and carried, through air jets, to a pipeline structure inside which orientation of same occurs. The sock is then picked up by a loader fitting it on a tubular sock-modeling piece or shaper on which a particular positioning is carried out which is necessary for automatic loading of the sock on the linking machine. Generally, the loader comprises a four-season turntable. Both orientation and positioning of the sock are carried out by sensor systems detecting the specific features of the goods (such as notches executed in the rubber band region, for example). In a manual loading process the sock is merely inserted in the inlet guides of the linking machine by a seamstress or an operator. Generally, manual loading takes place where an automatic loading system is not present due to the fact that it is very expensive or where the sock is a so-called "foot-protector" (i.e. it is very short and it only covers the foot portion at the inside of the shoe) or a children sock because, due it its very reduced size, it is not possible to orientate it in the pick-and-place station.

As well-known, the linking step terminates with a step of reversing the sock since sewing is carried out, for aesthetic reasons, on the reverse side and at a predetermined position.

The sock is then transferred to the boarding region manually i.e. not by an automatic system. The boarding machine too can involve automatic or manual loading of the sock. The automatic loading system is very similar to the one described for the linking machine. The two systems substantially differentiate from each other due to the references taken for orientation in the pick-and-place station and for loading onto the loader since during this step only one end of the sock is open because sewing of the fingertip has already occurred.

Currently, the boarding machine comprises a rotating board on which a plurality of sock-modeling pieces is mounted which have a substantially flattened conformation. This board is handled between a series of stations in succession which may comprise one or more stretching stations, a steam-ironing chamber, a drying station, a control station and a device for extracting the socks from their modeling pieces and positioning them on a conveyor belt, for example.

The above described system however has some drawbacks. First of all the presence of two loading systems of substantially identical operation, one for the linking machine and one for the boarding machine, involves a waste of sources and an increase in costs. This drawback is still more important where an automatic loading is concerned since the pick-and-place stations and the loader represent a very heavy investment from the economic point of view. In addition, the presence of an operator is always required to enable linking or boarding of all types of socks since the so-called foot-protectors cannot be loaded in an automatic manner. Secondly, in a traditional process two interconnected steps such as linking and boarding are not directly connected and are often positioned at regions that are very far from each other, which brings about ineffectiveness above all in terms of times and costs.

Under this situation, it is an aim of the present invention to obviate the above mentioned drawbacks by providing an apparatus for automatic transfer of textile articles from a linking machine to a boarding machine that makes the sock production process very efficient in terms of times and costs.

A further aim of the invention is to make available an apparatus for automatic transfer of textile articles from a linking machine to a boarding machine that can be used for every type of socks. A still further aim of the invention is to make available an apparatus for automatic transfer of textile articles from a linking machine to a boarding machine that enables a rational and cheap use of the different resources consisting of the operators and the handling means, for example. In addition the present invention aims at providing an apparatus for automatic transfer of textile articles from a linking machine to a boarding machine that is reliable from a qualitative point of view. Finally, the invention aims at providing an apparatus for automatic transfer of textile articles from a linking machine to a boarding machine that is of easy manufacture and reduced cost.

The foregoing and still further aims that will become more apparent from the following description are achieved, in accordance with the present invention, by an apparatus for automatic transfer of textile articles from a linking machine to a boarding machine in accordance with the appended claims.

Further features and advantages of the invention will be best understood from the description of a preferred but not exclusive embodiment of the device shown by way of example in the accompanying drawings, in which.

Figure 1:
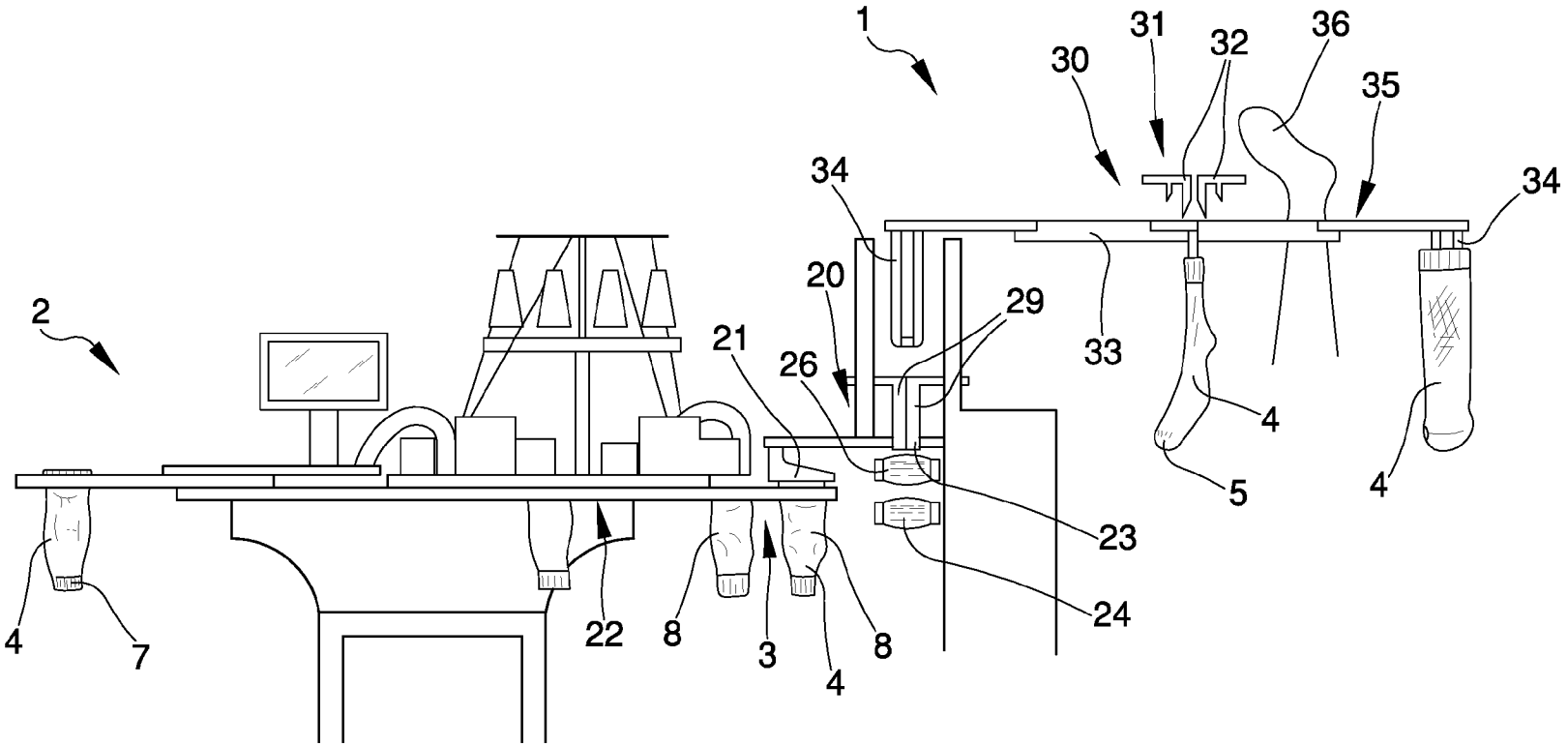
FIG. 1 is a front view of an apparatus in accordance with the invention associated with a linking machine in a preferred embodiment.

With reference to the drawings, an apparatus in accordance with the invention for automatic transfer of textile articles 4 from a linking machine to a boarding machine is generally identified by reference numeral 1 in the accompanying drawings. FIG. 1A shows an improved portion of the present invention.

Figure 1A:
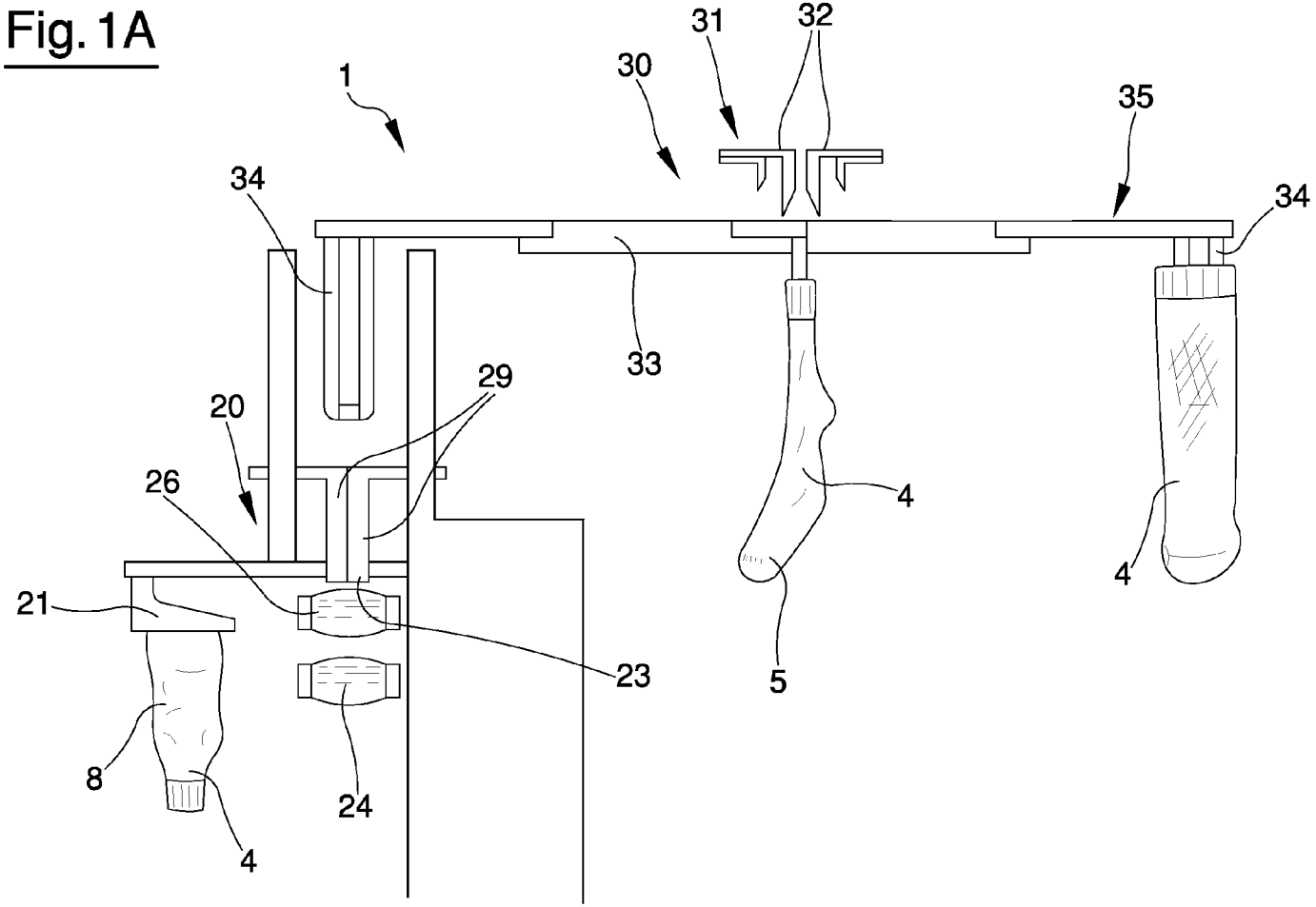
FIG. 1A shows an improved portion of the present invention.

This apparatus 1 can be directly connected to the outlet 3 of a linking machine 2 (as shown in FIG. 1) and the inlet of a boarding machine (not shown). It comprises automatic-transfer means operatively active on the linking machine 2 and is adapted to pick up at least one textile article 4 from the linking machine 2 to transfer it to the boarding machine. In particular, the textile article 4, preferably a sock for men, women or children, is transferred to the boarding machine in accordance with a predetermined orientation so that the last-mentioned machine can be loaded in an automatic manner and a high qualitative standard of the finished product can be ensured.

The linking machine 2 and boarding machine mentioned in the following specification are of known type and therefore are not described herein in detail.

Figure 3:
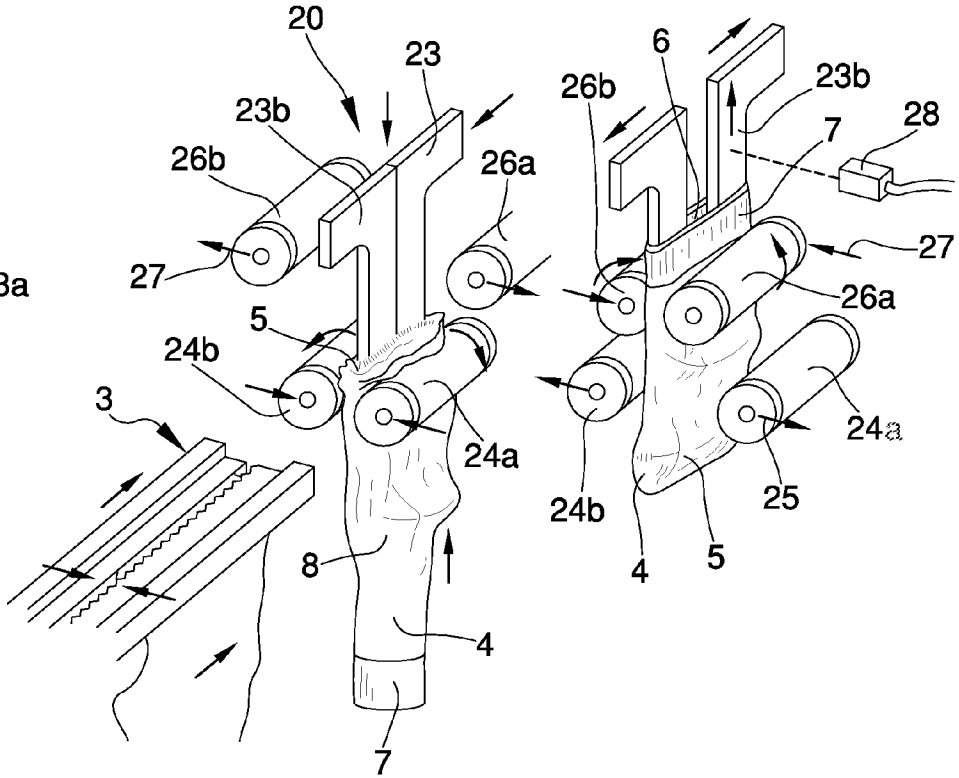
FIG. 3 is a perspective view of the reversing means of the apparatus in FIG. 1 in a second operating position.
Figure 2:
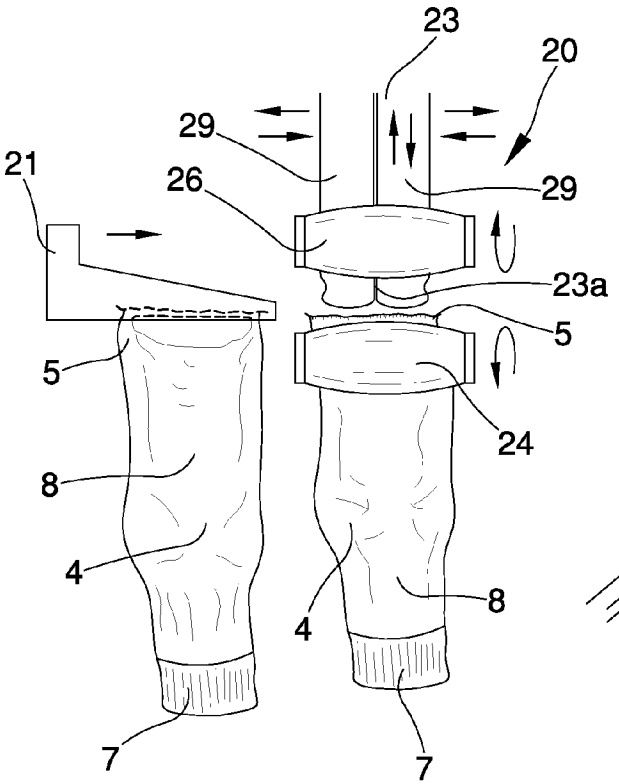
FIG. 2 is a front view of the reversing means of the apparatus seen in FIG. 1 in a first operating position.

The outlet 3 of the sewing station 22 of the linking machine 2 is preferably connected to a reversing means 20 because sewing of the sock fingertip is carried out on a reversed portion 8 thereof for aesthetic reasons. This reversing means 20 that, as already said, performs the function of moving the textile article 4 from a reversed position to a right position in which the textile article 4 has a precise orientation, can be part of the linking machine 2 or be advantageously included in the apparatus 1 for transfer of textile articles 4 being the object of the invention. In more detail, this reversing means 20 comprises a supporting element 23 that preferably is a T-shaped flattened element and at least one pair of lower rollers 24 disposed around said supporting element 23 (FIGS. 2 and 3). The lower rollers 24 are movable in a direction 25 substantially perpendicular to their rotation axis between a first position at which they are spaced apart relative to the supporting element 23 and a second position at which they are disposed close to a lower portion 23*a* of the supporting element 23, as viewed from FIG. 3.

When in this second position the lower rollers 24 set the lower portion 5 of the textile article 4 (i.e. the tip on which a sewing operation is carried out by the linking machine 2) on the lower portion 23*a* of the supporting element 23 and, through rotation in a mutually opposite direction, carry out straightening of the textile article 4 on the supporting element 23 that is housed in an inner portion 6 of the textile article 4. The reversing means 20 is also preferably provided with feeding elements 21 consisting of at least one clamp as shown in FIG. 2 for example, to pick article 4 up from the sewing station 22 of the linking machine 2 and move it close to the lower portion 23*a* of the supporting element 23, between the lower rollers 24.

A further component of the reversing means 20 is a pair of upper rollers 26 positioned over the pair of lower rollers 24. The upper rollers 26 too are movable in a direction 27 substantially perpendicular to their rotation axis between a first position at which they are spaced apart relative to the supporting element 23 and a second position at which they are placed close to an upper portion 23*b* of the supporting element 23. These upper rollers 26 have the function of co-operating with the lower rollers 24 to complete positioning of the textile article 4 on the supporting element 23. In particular, as viewed from FIG. 3, the operation of reversing article 4 begins due to a clockwise movement of the lower roller 24*a* and counter-clockwise movement of the lower roller 24*b* during which the supporting element 23 moves to a lower position in a vertical direction and the pair of upper rollers 26 is in the first position.

When article 4 has been completely reversed, the upper rollers 26 move to the second position through rotation in the same direction as the lower rollers 24 (i.e. roller 26*a* rotate in a clockwise direction and roller 26*b* rotates in a counter-clockwise direction) while the lower rollers 24 reverse their motion (i.e. roller 24*a* rotates in a counter-clockwise direction and roller 24*b* in a clockwise direction) to exert a pulling action on, and spread out article 4. The upper rollers 26 are preferably driven by control means 26 verifying the position of article 4 on the supporting element 23; this position is very important since transfer of the textile articles 4 between the two machines takes place in an automatic manner, without any manual intervention. The reversing means 20 of an apparatus 1 in accordance with the invention differentiates from the known art means because the supporting element 23 comprises two movable thin plates 29 moving between a joined position at which said thin plates 29 are adjacent and a detached position at which they are separated in order to pull and stretch the textile article 4 (FIG. 3). Advantageously, the thin plates 29 are in an adjacent position when the lower rollers 24 or upper rollers 26 are in the second position and in a detached position once the textile article 4 has been positioned on the supporting element 23. Therefore, instead of letting the reversed article 4 fall into an underlying basket, as in the known art, the reversing means 20 of an apparatus 1 in accordance with the invention exert a pulling action on article 4 and retain it, in particular the upper portion 7 of it that corresponds to the region provided with the rubber band, by moving the thin plates 29 to a detached position.

Figure 11:
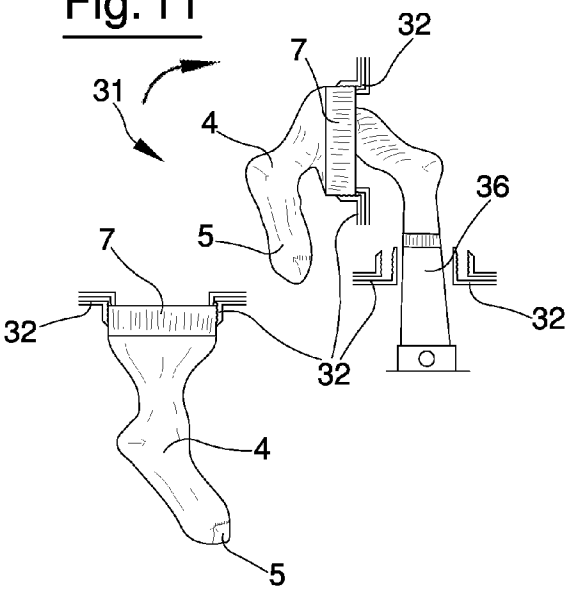
FIG. 11 is a diagrammatic view of the movement of the loading means seen in FIG. 9 or the apparatus seen in FIG. 1.

Still in accordance with the invention, the transfer means 30 comprises loading means 31 to transfer the textile article 4 to the boarding machine, which means advantageously comprises gripping elements 32 adapted to hook the upper portion of article 4 to rotate it substantially through 180° so as to fit it onto a sock-modeling piece for the boarding operation 36 of the boarding machine, as shown in FIG. 11. These gripping elements are represented by a pair of clamps for example, that are adapted to hook two opposite portions of the diameter of the upper portion 7 of the textile article 4 (FIGS. 8 and 10).

Figure 10:
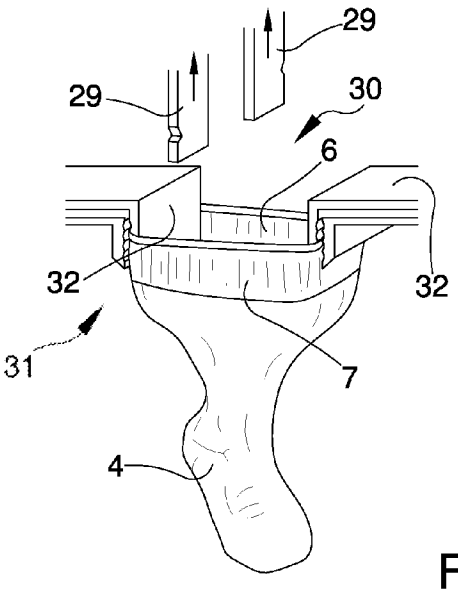
FIG. 10 shows a perspective view of the loading means in FIG. 9 in a second operating position.
Figure 9:
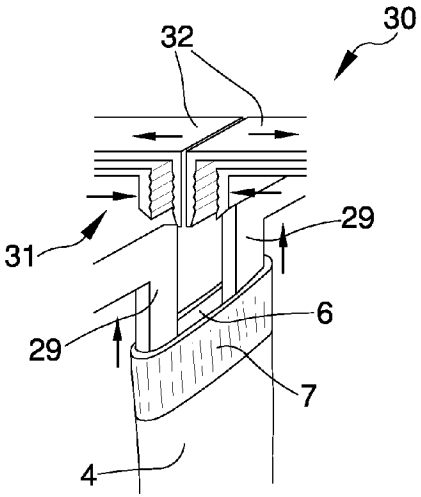
FIG. 9 shows a perspective view of the loading means of the apparatus in an embodiment different from the preferred one in a first operating position.

In a first variant of the invention, shown in FIGS. 9 and 10, the gripping elements 32 pick the textile article 4 up directly from the thin plates 29 when the latter are in the detached position.

Figure 5:
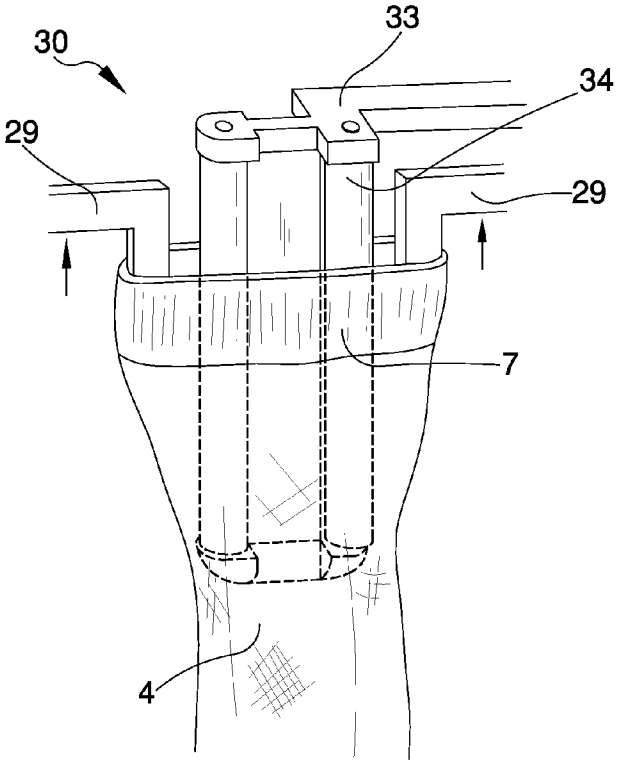
FIG. 5 is a perspective view of the loading turntable of the apparatus in FIG. 1 in a second operating position.
Figure 4:
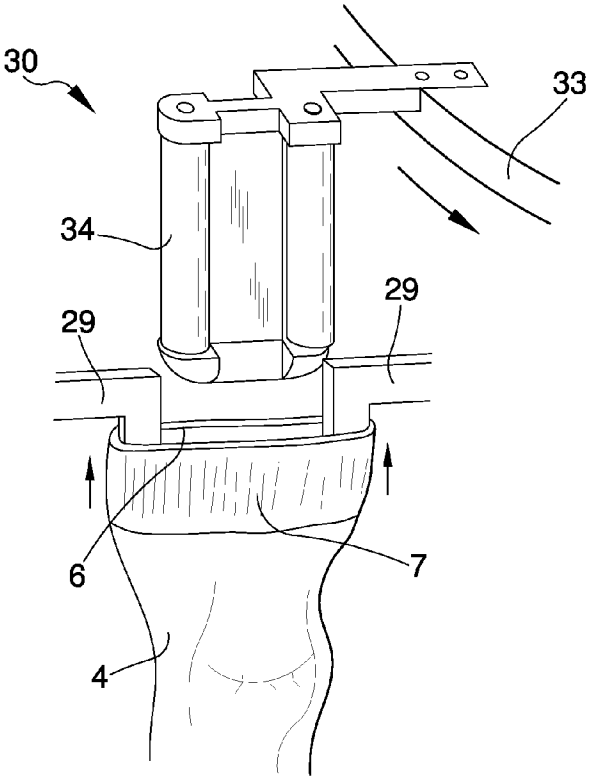
FIG. 4 is a perspective view of a loading turntable of the apparatus in FIG. 1 in a first operating position.
Figure 8:
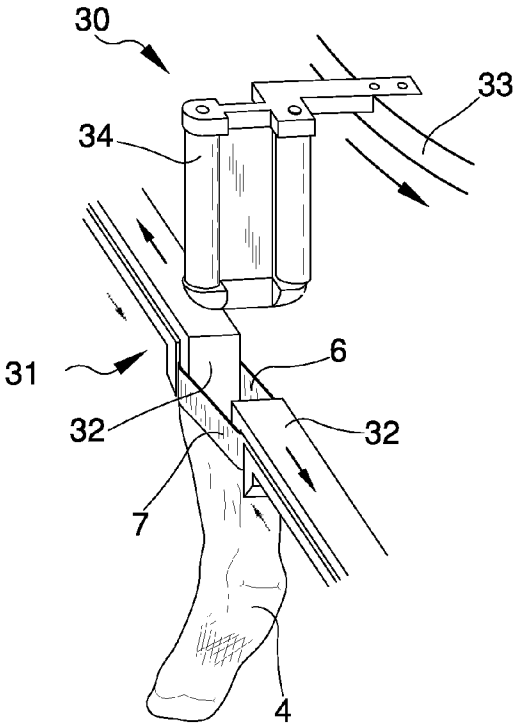
FIG. 8 is a perspective view of the loading means of the apparatus in FIG. 1 in a second operating position.
Figure 7:
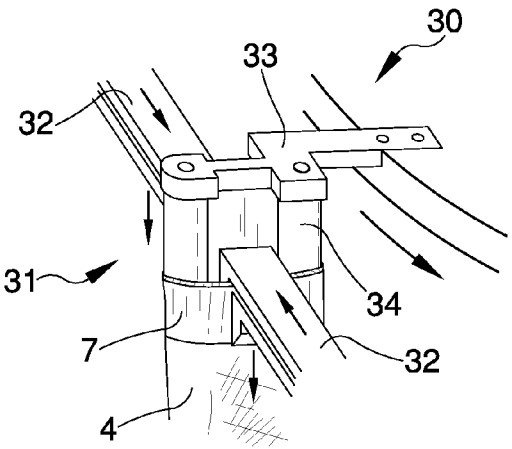
FIG. 7 is a perspective view of the loading means of the apparatus in FIG. 1 in a first operating position.
Figure 6:
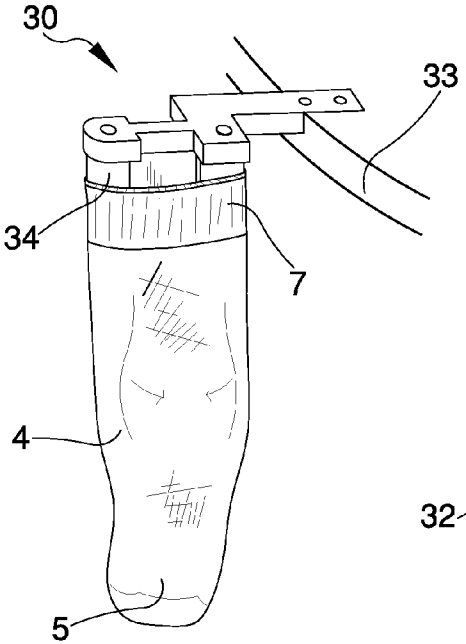
FIG. 6 is a perspective view of the loading turntable of the apparatus in FIG. 1 in a third operating position.

In a preferred embodiment of the invention (FIGS. 1, 4-8), on the contrary, the transfer means 30 comprises a loading turntable 33 and the gripping elements 32 pick the textile article 4 up from said loading turntable 33 (FIGS. 7 and 8). Said loading turntable 33 is known by itself and can be of the type disclosed in the U.S. Patent Application No. 2003/0015398, for example. In particular, the turntable 33 comprises at least one transferring element 34 adapted to pick up the textile article 4 from the supporting element 23 by insertion through the thin plates 29 into the inner portion 6 thereof, as shown in FIGS. 4 and 5.

Advantageously, the transferring element 34 handles article 4 through some stations defining a loading path 35. For instance, the stations can be four in number and be respectively dedicated to picking up of the textile article 4, control of the article orientation and position, possibly followed by a new orientation and loading onto the boarding machine, where the loading means 31 is active.

A description of a method of automatically transferring textile articles 4 from a linking machine 2 to a boarding machine in accordance with the previous disclosure will be given hereinafter.

This method is characterised in that it comprises the step of automatically picking up at least one textile article 4 from the linking machine 2 and the step of loading the textile article 4 onto the boarding machine.

In particular, the step of picking up the textile article comprises the step of reversing the textile article 4, i.e. turning it from a reversed position to a right position, which step in turn consists of a series of under-steps. In fact, the step of reversing the textile article 4 comprises the step of taking the textile article 4 from a sewing station 22 and positioning a lower portion 5 thereof at a supporting element 23 by means of a pair of lower rollers 24. Subsequently there is the step of driving the lower rollers 24 in rotation in a mutually opposite direction to cause the textile article 4 to be unwound on the supporting element 23 which keeps inserted in an inner portion 6 of the textile article 4, the step of driving the pair of upper rollers 26 in rotation in a mutually opposite direction to position the textile article 4 on the supporting element 23, the step of controlling positioning of article 4 on the supporting element 23 and exerting a pulling action on an upper portion 7 thereof. The last-mentioned step is advantageously accomplished by bringing the two thin plates 29 of the supporting element 23 to a detached position.

Still in accordance with the invention, the step of loading the textile article 4 onto the boarding machine comprises the steps of hooking the upper portion of the textile article 4 and inserting article 4 on a sock-modeling piece for the boarding operation 36 by rotating it through substantially 180°.

In a first variant of the method herein disclosed, the step of loading the textile article 4 onto the boarding machine directly follows the step of reversing the textile article 4.

In a preferred embodiment of the method, on the contrary, there is also a step of transferring article 4 to the boarding machine downstream of the step of picking article 4 up and upstream of the step of loading article 4. The last-mentioned step of transferring the textile article 4 to the boarding machine comprises the sub-steps of inserting a transferring element 34 into the inner portion 6 of the textile article 4 between the thin plates 29 and handling the textile article 4 along a loading path 35. Preferably, during the last-mentioned steps a qualitative control of article 4 takes place and possibly a new orientation of same. In this variant the step of loading the textile article 4 directly follows the step of transferring the textile article 4.

Practically the materials used as well as the sizes can be of any nature, depending on requirements. In addition, all of the details can be replaced by technically equivalent elements.

The invention achieves important advantages.

First of all, an apparatus for automatic transfer of textile articles from a linking machine to a boarding machine in accordance with the invention enables an automatic transfer to the boarding station also of the so-called "foot-protectors" as well as of children socks that in conventional machines must be loaded manually being it impossible to carry out an automatic loading due to the reduced size of same.

In addition, the automatic transfer apparatus herein disclosed enables the conventional loading means for the boarding machine to be eliminated. This involves an advantage in terms of costs above all when the apparatus is used to replace the automatic loading system formed of the pick-and-place station and the loader, since it represents an important investment from an economical point of view.

A further advantage is given by the fact that the apparatus being the object of the invention enables the linking machine to be operatively connected to the boarding machine, which machines perform two directly sequential working operations in the production process of textile articles such as socks. This involves an important improvement in the efficiency of the production process itself, due to a more rational plant lay-out and to a more rational use of the resources above all in terms of handling and stocks, which therefore will bring about important benefits in the production costs and times.

Finally, the different steps for control of the orientation and positioning of the textile articles carried out on the apparatus during the transfer process ensure a very high quality of the product. The high qualitative standard is further ensured where loading onto the linking machine takes place manually because there is an operator supervising and controlling the whole linking, transferring and boarding process.

The invention claimed is:

1. A method of automatically transferring textile articles from a linking machine to a boarding machine, comprising the step of automatically picking up at least one of said textile articles from said linking machine, the step of loading said textile article onto said boarding machine, and the step of transferring, in accordance with a predetermined orientation, said textile article to said boarding machine downstream of said step of automatically picking up said textile article and upstream of said step of loading said textile article, wherein said step of automatically picking up said textile article comprises a step of taking said textile article from a sewing station and wherein said step of transferring said textile article comprises a step of reversing said textile article, turning it from a reversed position to a right position, wherein said step of reversing said textile article comprises the steps of:

positioning a lower portion of said article on a supporting element by means of a pair of lower rollers, said lower rollers being movable in a direction substantially perpendicular to a rotation axis thereof between a first position at which said lower rollers are spaced apart relative to said supporting element and a second position at which said lower rollers are placed at a lower portion of said supporting element, with said lower rollers in said second position, driving said lower rollers in rotation in a mutually opposite direction so as to unwind said textile article on said supporting element, said supporting element being in an inner portion of said textile article, driving a pair of upper rollers in rotation in a mutually opposite direction to position said textile article on said supporting element, controlling positioning of said textile article on said supporting element and exerting a pulling action on an upper portion of said textile article, wherein said step of exerting a pulling action on said upper portion of said textile article takes place by means of two thin plates of said supporting element being brought to a detached position, wherein said step of transferring said textile article is performed by means of automatic-transfer means operatively active on the linking machine and configured for picking up at least one textile article from the linking machine and for transferring it to the boarding machine, said transfer means comprising a loading turntable and/or gripping elements.

2. A method as claimed in claim 1, characterised in that the step of loading said textile article on said boarding machine comprises the steps of hooking said upper portion of said textile article and fitting said textile article on a sock-modeling piece for the boarding operation by rotating said textile article through substantially 180°.

3. A method as claimed in claim 1, characterised in that said step of loading said textile article onto said boarding machine directly follows said step of reversing said textile article.

4. A method as claimed in claim 1, characterised in that said step of transferring said textile article comprises the steps of inserting a transferring element into said inner portion of said textile article between said thin plates and handling said textile article along a loading path.

5. A method of automatically transferring textile articles from a linking machine to a boarding machine, comprising the step of automatically picking up at least one of said textile articles from said linking machine, the step of loading said textile article onto said boarding machine, and the step of transferring, in accordance with a predetermined orientation, said textile article to said boarding machine downstream of said step of automatically picking up said textile article and upstream of said step of loading said textile article, wherein said step of automatically picking up said textile article comprises a step of taking said textile article from a sewing station and wherein said step of transferring said textile article comprises a step of reversing said textile article, turning it from a reversed position to a right position, wherein said step of reversing said textile article comprises the steps of:

positioning a lower portion of said article on a supporting element, unwinding by means of a pair of translatable lower rollers said textile article on said supporting element, said supporting element being in an inner portion of said textile article, controlling positioning of said textile article on said supporting element and exerting a pulling action on an upper portion of said textile article, wherein said step of exerting a pulling action on said upper portion of said textile article takes place by means of two thin plates of said supporting element being brought to a detached position, wherein said step of transferring said textile article is performed by means of automatic-transfer means operatively active on the linking machine and configured for picking up at least one textile article from the linking machine and for transferring it to the boarding machine, said transfer means comprising a loading turntable and/or gripping elements.

6. A method as claimed in claim 5, characterised in that said positioning of a lower portion of said article at a supporting element is carried out by means of a pair of lower rollers, and said unwinding of said textile article on said supporting element is carried out by driving said lower rollers in rotation in a mutually opposite direction.

7. A method as claimed in claim 5, characterised in that said step of reversing said textile article comprises the step of driving a pair of upper rollers in rotation in a mutually opposite direction to position said textile article on said supporting element, said step of driving a pair of upper rollers being performed before said steps of controlling positioning of said textile article on said supporting element and exerting a pulling action on an upper portion of said textile article.

8. A method as claimed in claim 5, characterised in that the step of loading said textile article on said boarding machine comprises the steps of hooking said upper portion of said textile article and fitting said textile article on a sock-modeling piece for the boarding operation by rotating said textile article through substantially 180°.

9. A method as claimed in claim 5, characterised in that said step of loading said textile article onto said boarding machine directly follows said step of reversing said textile article.

10. A method as claimed in claim 5, characterised in that said step of transferring said textile article comprises the steps of inserting a transferring element into said inner portion of said textile article between said thin plates and handling said textile article along a loading path.

* * * * *